US007264341B2

(12) United States Patent
Katayama

(10) Patent No.: US 7,264,341 B2
(45) Date of Patent: Sep. 4, 2007

(54) INK CARTRIDGE AND INK-JET PRINTER

(75) Inventor: Naoki Katayama, Kariya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 360 days.

(21) Appl. No.: 10/982,944

(22) Filed: Nov. 8, 2004

(65) Prior Publication Data

US 2005/0099473 A1 May 12, 2005

(30) Foreign Application Priority Data

Nov. 11, 2003 (JP) ..... 2003-381476

(51) Int. Cl.
*B41J 2/175* (2006.01)

(52) U.S. Cl. ..... 347/86

(58) Field of Classification Search ..... 347/86
See application file for complete search history.

(56) References Cited

U.S. PATENT DOCUMENTS 5,903,292 A 5/1999 Scheffelin et al.
6,036,306 A 3/2000 Haigo
6,082,851 A * 7/2000 Shihoh et al. ..... 347/85
6,536,861 B1 * 3/2003 Usui et al. ..... 347/7
6,702,427 B2 3/2004 Shimizu et al.
2003/0067517 A1 * 4/2003 Iri et al. ..... 347/85
2004/0100537 A1 5/2004 Lui et al.

FOREIGN PATENT DOCUMENTS

BE 1 008 723 A3 7/1996
EP 1 232 870 A1 8/2002
EP 1 232 871 A1 8/2002
JP A 11-58772 3/1999
JP A 2001-328279 11/2001
JP A 2002-307711 10/2002

* cited by examiner

*Primary Examiner*—An H. Do
(74) *Attorney, Agent, or Firm*—Oliff & Berridge, PLC

(57) ABSTRACT

An ink cartridge which is to be mounted on an ink-jet printer and from which ink is supplied to at least one nozzle of an ink-jet printing head of the ink-jet printer, the ink cartridge including: an ink tank in which ink is stored; an ink outlet hole which is formed in a wall of the ink cartridge that defines the ink tank and through which the ink flows out of the ink tank; and an air inlet hole which is formed in the wall of the ink cartridge that defines the ink tank and through which air flows into the ink tank. The air inlet hole is formed within an area of the wall in which the air inlet hole contacts the ink stored in the ink tank.

19 Claims, 3 Drawing Sheets

INK CARTRIDGE AND INK-JET PRINTER

The present application is based on Japanese Patent Application No. 2003-381476 filed Nov. 11, 2003, the contents of which are incorporated herein by reference.

BACKGROUND OF THE INVENTION

1. Field of the Invention

The present invention relates in general to an ink cartridge for supplying, with ink, an ink-jet printing head which performs printing by ejecting the ink, and an ink-jet printer including the ink cartridge.

2. Discussion of Related Art

There is known an ink-jet printer arranged to perform printing by ejecting ink through nozzles onto a recording medium. Such an ink-jet printer is equipped with an ink cartridge removably mounted thereon, as disclosed in JP-A-2001-328279 (FIG. 1, in particular). In such an ink cartridge, however, where a vent hole (air introducing hole) of an ink storing chamber (ink tank) is located above the ink storing chamber, the surface of the ink in the ink storing chamber is exposed to an atmosphere, in other words, an atmospheric pressure acts on the ink surface. In this arrangement, when the level of the ink surface decreases with consumption of the ink, a back pressure of the ink acting on the nozzles varies. The variation in the back pressure of the ink which acts on the nozzles may adversely influence an accuracy of ejection of the ink from the nozzles. Hereinafter, "the level" refers to a "height level".

In view of the above, the ink-jet printer is generally equipped with a mechanism for suppressing or inhibiting the variation in the back pressure of the ink. One example of such an ink-jet printer is disclosed in U.S. Pat. No. 6,702,427 B2 (FIG. 4, in particular) corresponding to JP-A-2002-307711. The disclosed ink-jet printer is equipped with a buffer tank which is connected to nozzles and in which ink is stored with its surface level kept approximately constant. The buffer tank has an ink supply tube in the form of a hollow needle for supplying the buffer tank with the ink in the ink cartridge and an air introducing tube in the form of a hollow needle for introducing air into the ink cartridge. The ink supply tube and the air introducing tube are disposed so as to extend through an upper wall portion of the buffer tank. Within the buffer tank, the ink supply tube extends downwardly farther than the air introducing tube, near the bottom of the buffer tank.

In a state in which the ink is not ejected from the nozzles, the ink surface is in the vicinity of a lower end of the air introducing tube. In this state, a meniscus of the ink is formed inside the lower end of the air introducing tube, so that the air is not introduced through the air introducing tube into the ink cartridge. Accordingly, the ink is not supplied from the ink cartridge to the buffer tank. When the ink is ejected from the nozzles, the ink is supplied to the nozzles through an ink supply hole formed at the bottom of the buffer tank and the level of the ink surface in the buffer tank decreases, so that the ink surface separates from the lower end of the air introducing tube and the meniscus in the air introducing tube is broken. As a result, the air enters the air introducing tube and is accordingly introduced into the ink cartridge. Simultaneously, the ink is supplied from the ink cartridge to the buffer tank via the ink supply tube. When the surface level of the ink in the buffer tank reaches in the vicinity of the lower end of the air introducing tube, the air is not allowed to be introduced into the ink cartridge through the air introducing tube, whereby the supply of the ink into the buffer tank stops. In this case, the variation in the back pressure acting on the nozzles is not influenced by the amount of the ink remaining in the ink cartridge, but influenced only by the amount of the ink remaining in the buffer tank whose volume is small, resulting in suppression of the variation in the back pressure.

SUMMARY OF THE INVENTION

In the arrangement described above, it is needed to break the meniscus formed at the lower end of the air introducing tube so as to compensate for the amount of the ink which is consumed by ejection. The strength of the meniscus is determined depending upon the composition and the kind of the ink, and the meniscus is not broken unless a certain degree of the back pressure is caused in accordance with the consumption of the ink. Namely, the level of the ink surface needs to further decrease after the ink surface has separated from the lower end of the air introducing tube. In this instance, the back pressure acting on the nozzles is determined depending upon the level of the ink surface in the buffer tank. Accordingly, the back pressure acting on the nozzles varies. Further, the amount of the decrease in the level of the ink surface required for breaking the meniscus changes depending upon the composition and the kind of the ink, so that the degree of variation in the back pressure also varies depending upon the composition and the kind of the ink. Furthermore, in the arrangement described above, the buffer tank is installed on the main body of the printer, so that the ink may leak through the ink supply tube when the printer vibrates with the ink cartridge removed therefrom.

It is therefore an object of the present invention to provide an ink cartridge which prevents, with a simplified structure, a variation in the back pressure acting on the nozzles and an ink-jet printer including the ink cartridge.

The object indicated above may be achieved according to a first aspect of the present invention, which provides an ink cartridge which is to be mounted on an ink-jet printer and from which ink is supplied to at least one nozzle of an ink-jet printing head of the ink-jet printer, the ink cartridge comprising: an ink tank in which ink is stored; an ink outlet hole which is formed in a wall of the ink cartridge that defines the ink tank and through which the ink flows out of the ink tank; and an air inlet hole which is formed in the wall of the ink cartridge that defines the ink tank and through which air flows into the ink tank. The air inlet hole is formed within an area of the wall in which the air inlet hole contacts the ink stored in the ink tank.

In the ink cartridge constructed as described above, the variation in the back pressure of the ink acting on the at least one nozzle can be suppressed or inhibited with a simple structure that the air inlet hole is formed within the area of the wall in which the air inlet hole contacts the ink stored in the ink tank. Further, the variation in the back pressure is not caused even when the level of the ink surface changes with consumption of the ink, effectively increasing a range of location of the ink cartridge within which favorable ink ejecting conditions are fulfilled.

The object indicated above may also be achieved according to a second aspect of the present invention, which provides an ink-jet printer, comprising: an ink-jet printing head having an ink ejection portion in which a plurality of ink ejection nozzles are arranged; and an ink cartridge which is to be removably mounted on the ink-jet printer for supplying ink to the ink-jet printing head and which includes an ink tank in which the ink is stored, an ink outlet hole which is formed in a wall of the ink cartridge that defines the ink tank and through which the ink flows out of the ink tank, an air inlet hole which is formed in the wall of the ink cartridge that defines the ink tank and through which air flows into the ink tank. The ink cartridge is constructed such that the air inlet hole is formed within an area of the wall in which the air inlet hole contacts the ink stored in the ink tank and located at a height position which is lower than a height position of the ink ejection nozzles by a distance ranging from not less than 10 mm to not greater than 80 mm when the ink cartridge is mounted on the ink-jet printer.

The present ink-jet printer equipped with the ink cartridge constructed as described above enjoys the same advantages as those described above with respect to the ink cartridge according to the first aspect of the invention.

BRIEF DESCRIPTION OF THE DRAWINGS

The above and other objects, features, advantages and technical and industrial significance of the present invention will be better understood by reading the following detailed description of a preferred embodiment of the invention, when considered in connection with the accompanying drawings, in which.

DETAILED DESCRIPTION OF THE PREFERRED EMBODIMENT

Figure 1:
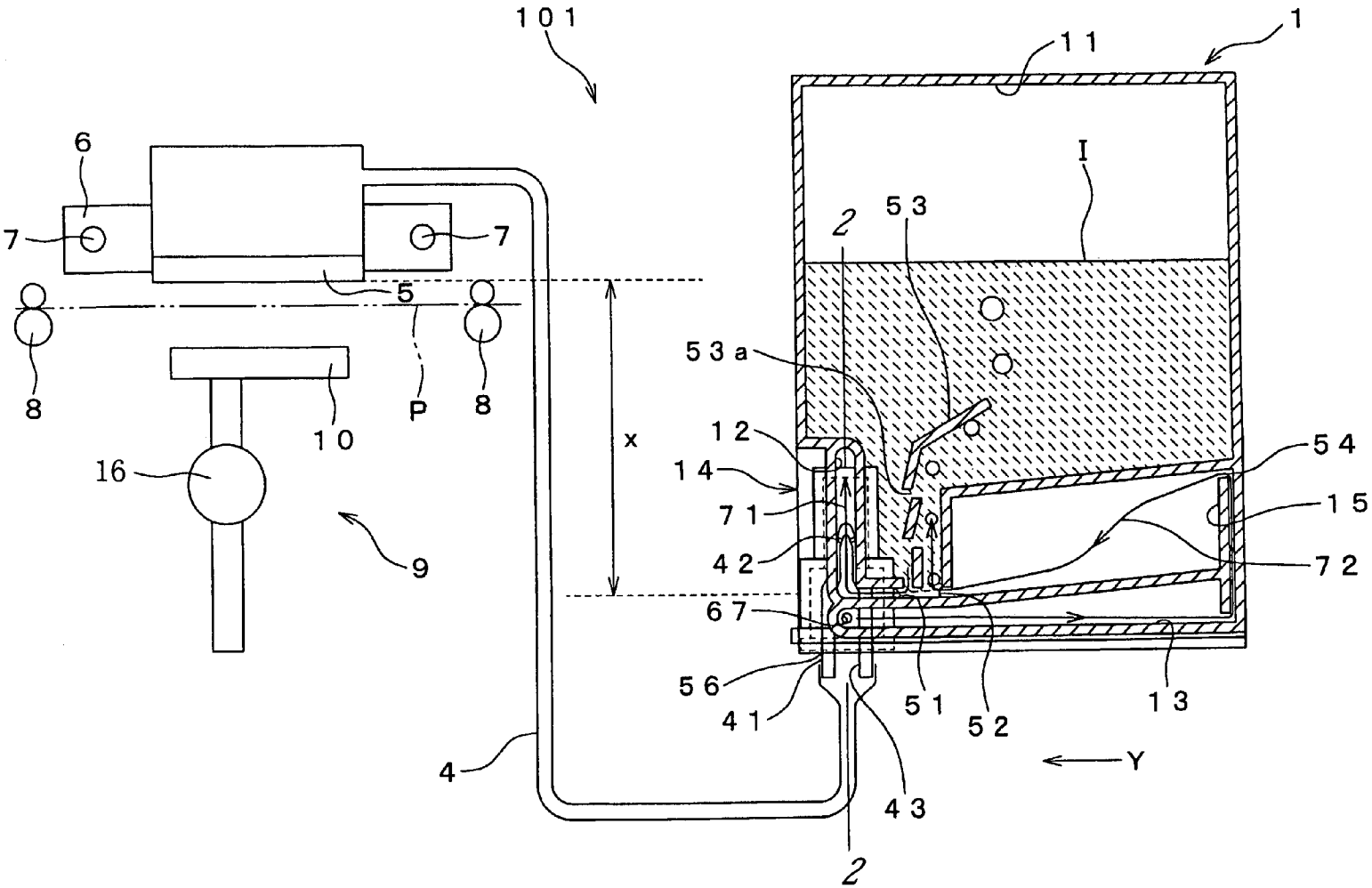
FIG. 1 is a view schematically showing an ink-jet printer equipped with an ink cartridge constructed according to one embodiment of the present invention.

Referring to the drawings, there will be described a preferred embodiment of the present invention.

Referring first to FIG. 1 of the schematic view, there is shown an ink-jet printer 101 equipped with an ink cartridge 1 constructed according to the preferred embodiment of the invention. The ink cartridge 1 is shown in cross section. In FIG. 1, an arrow 71 indicates a flow of ink while an arrow 72 indicates a flow of an atmosphere.

As shown in FIG. 1, the ink-jet printer 101 includes: an ink-jet printing head 5 for ejecting the ink toward a recording paper sheet P; the ink cartridge 1 which is mounted on a cartridge mount portion (not shown) of the ink-jet printer 101 and which stores the ink (indicated by "I" in FIG. 1) that is ejected by the ink-jet printing head 5; a carriage 6 which linearly reciprocates the ink-jet printing head 5 along a guide 7 in one direction (i.e., in a direction perpendicular to the sheet surface of FIG. 1); a feeding mechanism 8 for feeding the recoding paper sheet P in a direction perpendicular to the reciprocating direction of the ink-jet printing head 5 and parallel to a plane of an ink ejection surface as an ink ejection portion of the ink-jet printing head 5; and a purge device 9 for sucking the air and the viscosity-increased ink within the ink-jet printing head 5. The purge device 9 is located outwardly of the recording paper sheet P on the reciprocating path of the ink-jet printing head 5, and includes a purge cap 10 which is movable in directions toward and away from the ink ejection surface of the ink-jet printing head 5 and which is brought into contact with the ink ejection surface of the head 5, and a suction pump 16 for sucking the ink.

In the ink-jet printer 101 constructed as described above, the ink stored in the ink cartridge 1 is supplied to the ink-jet printing head 5 via the supply tube 4. The ink-jet printing head 5 is reciprocably moved by the carriage 6 and ejects the ink from the nozzles toward the recording paper sheet P fed by the feeding mechanism 8, whereby a desired image/character is formed on the recording paper sheet P. The ink-jet printing head 5 is moved onto the purge cap 10 of the purge device 9 by the carriage 6 every time when a predetermined time period elapses. Then, the purge cap 10 is moved so as to be brought into contact with the ink ejection surface of the ink-jet printing head 5. In this state, the suction pump 16 is operated so as to suck the air and the highly viscous ink from the nozzles of the ink-jet printing head 5.

Figure 2B:
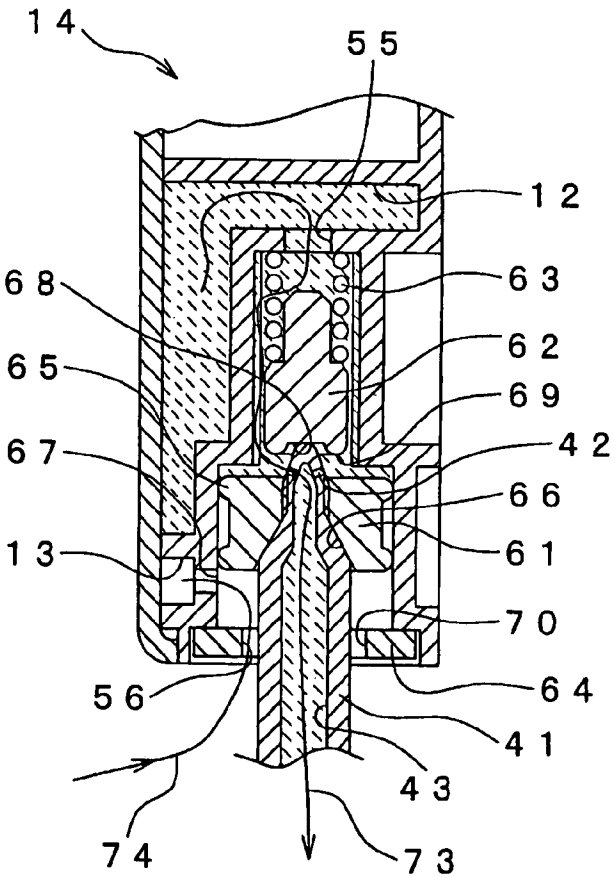
FIGS. 2A and 2B are cross sectional views showing a joint portion of the ink cartridge of FIG. 1.
Figure 2A:
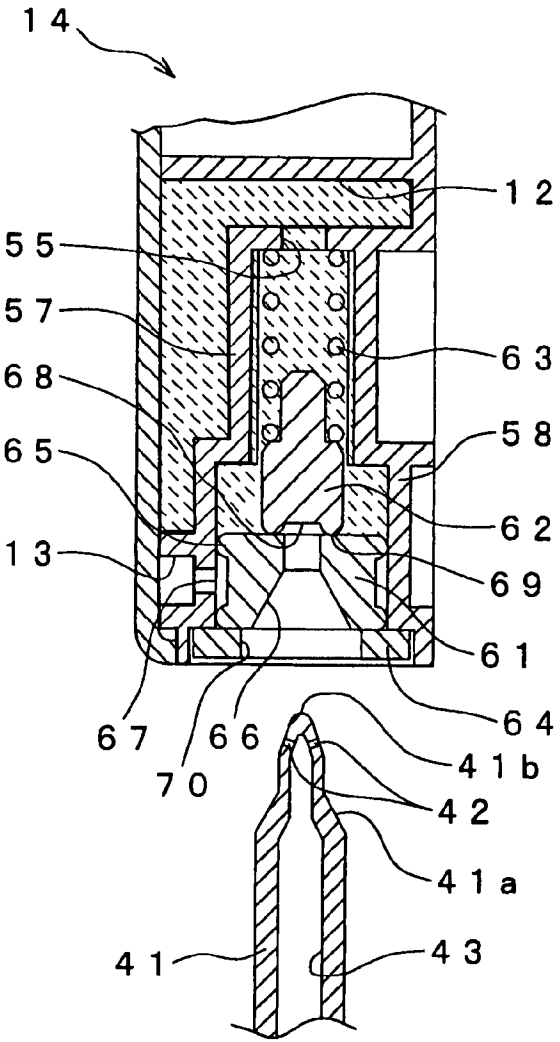

Next, there will be explained in detail the ink-jet printing head 5 and the ink cartridge 1. The ink-jet printing head 5 has the ink ejection surface as the ink ejection portion in which a multiplicity of ink ejection nozzles are formed, and ejects the ink supplied through the supply tube 4 from each nozzle under a control of a control device not shown. The supply tube 4 is connected at one of its opposite ends to the ink-jet printing head 5 and at the other end to an ink supply conduit 41. As shown in FIG. 2A, the ink supply conduit 41 is a tapered pipe-like member to be connected to the ink cartridge 1, and includes a closed distal end 41*b*, a plurality of ink inlet holes 42 formed in the vicinity of the distal end 41*b* along its periphery, and an intra-conduit ink passage 43 which communicates with an exterior via the ink inlet holes 42.

The ink cartridge 1 is a generally rectangular parallelopiped casing formed of synthetic resin. The ink cartridge 1 includes: an ink tank 11 for storing the ink I; an ink outlet passage 12 through which the ink stored in the ink tank 11 flows to an exterior of the ink cartridge 1; an air inlet passage 13 through which the air flows into the ink tank 11; and a joint portion 14 (FIGS. 2A and 2B) for connecting the ink outlet passage 12 and the ink supply conduit 41 to each other.

The ink tank 11 is a space defined by a wall of the ink cartridge 1 which is constituted by a plurality of wall portions, and includes an ink outlet hole 51 through which the stored ink is discharged out into the ink outlet passage 12 and an air inlet hole 52 through which the air flows into the ink tank 11. The ink tank 11 is constructed such that it is closed so as to be inhibited from communicating with an exterior except through the ink outlet hole 51 and the air inlet hole 52 and such that the ink in the ink tank 11 contacts the air only through the air inlet hole 52. The ink outlet hole 51 and the air inlet hole 52 are formed, with a mutually opposed relationship, in mutually opposing side wall portions at the bottom of the ink tank 111, which side wall portions constitute a part of the wall of the ink cartridge 1. The ink tank 11 communicates with the ink outlet passage 12 through the ink outlet hole 51 and with the air inlet passage 13 through the air inlet hole 52. The air inlet hole 52 has a dimension which is determined such that a meniscus is formed owing to surface tension of the ink so as to prevent the ink in the ink tank 11 from entering the air inlet passage 13 through the air inlet hole 52.

Within the ink tank 11, a guide wall 53 is provided between the ink outlet hole 51 and the air inlet hole 52. The guide wall 53 is for guiding air bubbles constituted by the air that has flowed through the air inlet hole 52, in an upward direction toward the top of the ink tank 11 and away from the ink outlet hole 51, so as to prevent the air bubbles from being sucked into the ink outlet hole 51. The guide wall 53 extends so as to be inclined such that an inclination with respect to a vertical direction of the ink cartridge 1 increases with an increase in a distance in the upward direction toward the top of the ink tank 11. The guide wall 53 is discontinuously provided with cutouts 53*a* formed.

The ink outlet passage 12 is located below the ink tank 11 and at a bottom portion of the ink cartridge 1, and communicates with the ink tank 11 via the ink outlet hole 51 and with the exterior of the ink cartridge 1 via a joint ink passage 55 which will be described. In a state in which the ink supply conduit 41 is connected to the joint portion 14, the ink outlet passage 12 communicates with the intra-conduit ink passage 43 of the ink supply conduit 41. The ink outlet passage 12 provides a flow of the ink from the ink outlet hole 51 to the joint ink passage 55. Namely, the flow of the ink provided by the ink outlet passage 12 extends from the ink outlet hole 51 upwardly in the vertical direction toward the top of the ink tank 11, then downwardly in the vertical direction toward the bottom of the ink tank 11 through the inside of the joint portion 14, and reaches the joint ink passage 55, as indicated by the arrow 71 in FIG. 1 and an arrow 73 in FIG. 2B.

The air outlet passage 13 is located below the ink tank 11 and at the bottom portion of the ink cartridge 1, and communicates with the ink tank 11 via the air inlet hole 52 and with the exterior of the ink cartridge 1 via an air introducing opening 56. The air inlet passage 13 includes as a part thereof a buffer tank 15 functioning as a buffer portion. The air introducing opening 56 is an opening formed around the outer periphery of the ink supply conduit 41 in a state in which the ink supply conduit 41 is connected to the joint portion 14. The air introducing opening 56 is formed in the lower surface of the ink cartridge 1 and has an annular shape whose center lies at a center of a circle in transverse cross section of the ink supply conduit 41.

The buffer tank 15 is located below and adjacent to the ink tank 11, and communicates in the vicinity of its bottom with the ink tank 11 via the air inlet hole 52 and communicates with the air introducing opening 56 via an air intake 54 formed in the vicinity of its top on the side remote from the air inlet hole 52. As shown in FIG. 1, the space in the buffer tank 15 is positioned above the air inlet hole 52 and below the air intake 54. The air inlet passage 13 provides a flow of the air from the air introducing opening 56 to the ink tank 11. Namely, the flow of the air provided by the air inlet passage 13 extends from the air introducing opening 56, passes the inside of the joint portion 14 and a path formed below the ink tank 11, extends upwardly in the vertical direction, passes the inside of the buffer tank 15 via the air intake 54, and reaches the ink tank 11 via the air inlet hole 52, as indicated by the arrow 72 in FIG. 1 and an arrow 74 in FIG. 2B.

By referring next to FIGS. 2A and 2B, there will be explained in detail the joint portion 14. FIGS. 2A and 2B are cross sectional views of the ink cartridge 1 taken along line 2-2 in FIG. 1 and seen from a direction indicated by an arrow "Y" in FIG. 1. FIG. 2A indicates a state in which the ink supply conduit 41 is not connected to the joint portion 14 while FIG. 2B indicates a state in which the ink supply conduit 41 is connected to the joint portion 14. In FIG. 2B, the arrow 73 indicates the flow of the ink while the arrow 74 indicates the flow of the air.

In the joint portion 14, the joint ink passage 55 constituting a part of the ink outlet passage 12 and extending vertically in the joint portion 14 is formed. The joint ink passage 55 is defined by an inner space formed by an upper cylindrical portion 57 and a lower cylindrical portion 58 of the joint portion 14. The lower cylindrical portion 58 has a diameter larger than that of the upper cylindrical portion 57. A communication hole 67 constituting a part of the air inlet passage 13 is formed through the wall thickness of the lower cylindrical portion 58. The joint portion 14 includes a packing 61, a valve element 62, a spring 63, and a sealing member 64 provided in the joint ink passage 55.

The packing 61 has a cylindrical shape and is slidably provided within the lower cylindrical portion 58. The packing 61 includes upper and lower annular protruding portions 65, 65 respectively formed at an upper and a lower end thereof and an insertion hole 66 into which the ink supply conduit 41 is inserted. The upper and lower annular protruding portions 65, 65 are held in sealing contact with the inner wall of the lower cylindrical portion 58, so as to prevent leakage of the ink through around the outer circumferential surface of the packing 61. The upper and lower annular protruding portions 65, 65 are configured to pass or shut off the flow of the air entering through the communication hole 67 into the air inlet passage 13. The insertion hole 66 of the packing 61 into which the ink supply conduit 41 is inserted is constituted by an upper cylindrical portion and a lower tapered portion whose configuration corresponds to a tapered portion 41*a* of the ink supply conduit 41.

The valve element 62 is provided above the packing 61 and shuts off or passes the flow of the ink in the joint ink passage 55. The valve element 62 has in its bottom surface a receiving portion 68 in the form of a concaved recess for receiving the distal end 41*b* of the ink supply conduit 41 inserted into the insertion hole 66 of the packing 61. In the state in which the ink supply conduit 41 is not connected to the joint portion 14 shown in FIG. 2A, the valve element 62 is disposed on the upper surface of the packing 61 such that an outer peripheral portion 69 of the valve element 62 located outwardly of the receiving portion 68 surrounds or encloses the insertion hole 66, whereby the ink in the joint ink passage 55 is inhibited from flowing into the insertion hole 66 of the packing 61.

The spring 63 biases the valve element 62 against the packing 61 and is disposed on the upper side of the valve element within the upper cylindrical portion 57. The sealing member 64 is for preventing the valve element 62 and the packing 61 biased by the spring 63 from slipping off out of the joint ink passage 55. A circular opening 70 is formed in the central portion of the sealing member 64. The circular opening 70 has an inside diameter larger than an outside diameter of the ink supply conduit 41. The ink supply conduit 41 is inserted into the insertion hole 66 of the packing 61 through the circular opening 70. When the ink supply conduit 41 is completely inserted through the circular opening 70 shown in FIG. 2B, the joint ink passage 55 is connected to the intra-conduit ink passage 43 of the ink supply conduit 41 and the air introducing opening 56 is formed around the outer periphery of the ink supply conduit 41.

Next, there will be explained a function or operation of the joint portion 14. As shown in FIG. 2A, in the state in which the ink supply conduit 41 is not connected to the joint portion 14, the valve element 62 biased by the spring 63 is held in sealing contact with the upper surface of the packing 61 such that the outer peripheral portion 69 of the valve element 62 located outwardly of the receiving portion 68 closely contacts the upper surface so as to surround or enclose the insertion hole 66 of the packing 61. Accordingly, the ink in the join ink passage 55 is inhibited from flowing into the insertion hole 66 of the packing 61, resulting in a shut-off of the ink flow in the joint ink passage 55. Further, the upper and lower annular protruding portions 65, 65 of the packing 61 are respectively held in sealing contact with the upper and lower portions of the inner wall of the lower cylindrical portion 58 so as to inhibit the air entering through the communication hole 67 from flowing into the air inlet passage 13, resulting in a shut-off of the air flow in the air inlet passage 13.

As shown in FIG. 2B, in the state in which the ink supply conduit 41 is connected to the joint portion 14, the tapered portion 41*a* of the ink supply conduit 41 inserted through the circular opening 70 of the sealing member 64 is held in engagement with the insertion hole 66 of the packing 61, so that, in accordance with the insertion of the ink supply conduit 41, the ink supply conduit 41, the packing 61, and the valve element 62 slide as a unit in the joint ink passage 55 in an upward direction (i.e., in a direction in which the ink supply conduit 41 is inserted). In this instance, the communication hole 67 formed through the thickness of the lower cylindrical portion 58 is located at a position lower than the lower annular protruding portion 65 of the packing 61, so that the communication hole 67 is placed at an open state in which the communication hole 67 is in communication with the air inlet passage 13 so as to allow the air entering through the communication hole 67 to flow into the air inlet passage 13.

When the ink supply conduit 41 is further inserted, the packing 61 is prevented from advancing by abutting contact thereof with the inner surface of the upper wall of the lower cylindrical portion 58, so that the ink supply conduit 41 is brought into sealing contact with the inner surface of the insertion hole 66 and the distal end 41*b* of the ink supply conduit 41 penetrates through and protrudes from the insertion hole 66. The distal end 41*b* of the ink supply conduit 41 which has penetrated through and protruded from the insertion hole 66 is brought into engagement with the receiving portion 68 of the valve element 62, permitting the ink supply conduit 41 and the valve element 62 to be further advanced or slid in the upward direction. In this instance, the valve element 62 separates from the packing 61 and the ink inlet holes 42 formed in the vicinity of the distal end 41*b* of the ink supply conduit 41 which has protruded from the insertion hole 66 are located outside the insertion hole 66. Accordingly, the joint ink passage 55 is connected to the intra-conduit ink passage 43 of the ink supply conduit 41, so that the ink in the joint ink passage 55 flows into the intra-conduit-ink passage 43 via the ink inlet holes 42. The ink which has flowed into the intra-conduit ink passage 43 is supplied to the ink-jet printing head 5 via the ink supply tube 4.

The ink cartridge 1 constructed as described above is removably mounted on the cartridge mount portion of the ink-jet printer 101. When the ink cartridge 1 is mounted on the cartridge mount portion, the ink outlet hole 51 is located below the ink tank 11, as seen in a gravity direction.

There will be next explained a positional relationship between the ink cartridge 1 and the ink-jet printing head 5. Since the nozzles of the ink-jet printing head 5 are always kept open, the ink may leak from the nozzles of the head 5 where an atmosphere-contact level Ln of the ink in the nozzles of the head 5 at which the ink in the nozzles contacts an atmosphere (in other words, a height level of a position of the ink in the nozzles at which the ink in the nozzles contacts the atmosphere) is lower than an atmosphere-contact level Lc of the ink in the ink cartridge 1 at which the ink in the ink cartridge 1 contacts the atmosphere (in other words, a height level of a position of the ink in the ink cartridge 1 at which the ink in the ink cartridge 1 contacts the atmosphere). On the contrary, where the atmosphere-contact level Ln of the ink in the nozzles of the head 5 is excessively higher than the atmosphere-contact level Lc of the ink in the ink cartridge 1, the amount of ejection of the ink may be insufficient at a predetermined ejection pressure generated for permitting the ink-jet printing head 5 to eject the ink, or the ink-jet printing head 5 may fail to eject the ink. Accordingly, it is important to take into account a height position of the air inlet hole 52 of the ink cartridge 1 with respect to a height position of the nozzles of the ink-jet printing head 5. In this respect, the inventor of the present invention has found that good ink ejection can be achieved without trouble or failure if the back pressure which is a pressure acting on the ink in the nozzles of the ink-jet printing head 5, i.e., a pressure based on Ln-Lc, is kept within a range from −10 mmaq to −80 mmaq. Therefore, the height position of the air inlet hole 52 which determines the atmosphere-contact level Lc of the ink in the ink cartridge 1 is determined to be lower than the height position of the nozzles by a distance or difference x (shown in FIG. 1) which ranges from 10 mm to 80 mm when the ink cartridge 1 is mounted on the ink-jet printer 101. Thus, in the present embodiment wherein the air inlet hole 52 is formed at the bottom of the ink tank 11 to be located at the height position which is the same as a height position of the ink outlet hole 51, the atmosphere-contact level Lc of the ink in the ink cartridge 1 does not vary irrespective of the amount of consumption of the ink. Therefore, the back pressure acting on the ink in the nozzles of the ink-jet printing head 5 can be always kept within the range from −10 mmaq to −80 mmaq irrespective of consumption of the ink. In other words, the back pressure can be kept within the preferable range which assures good ink ejection.

While, in the present embodiment, the height position of the air inlet hole 52 is approximately the same as the height position of the ink outlet hole 51, the height position of the ink outlet hole 51 may be lower than that of the air inlet hole 52. In this instance, as long as the height position of the ink inlet hole 51 is lower than the height position of the nozzles of the ink-jet printing head 5 by a distance ranging from 10 mm to 80 mm, in other words, as long as the height position of the ink inlet hole 51 with respect to that of the nozzles of the ink-jet printing head 5 is located within a range from −10 mm to −80 mm, the back pressure acting on the ink in the nozzles of the ink-jet printing head 5 can be kept in the above-indicated range from −10 mmaq to −80 mmaq until the ink is completely used up. For instance, where the height position of the air inlet hole 52 is located lower than the height position of the nozzles of the ink-jet printing head 5 by a distance of 10 mm, the back pressure acting on the ink in the nozzles can be kept within the above-indicated range until the ink is completely used up, if the height position of the ink outlet hole 51 is located lower than the height position of the air inlet hole 52 by a distance ranging from 0 mm to 70 mm.

Figure 3B:
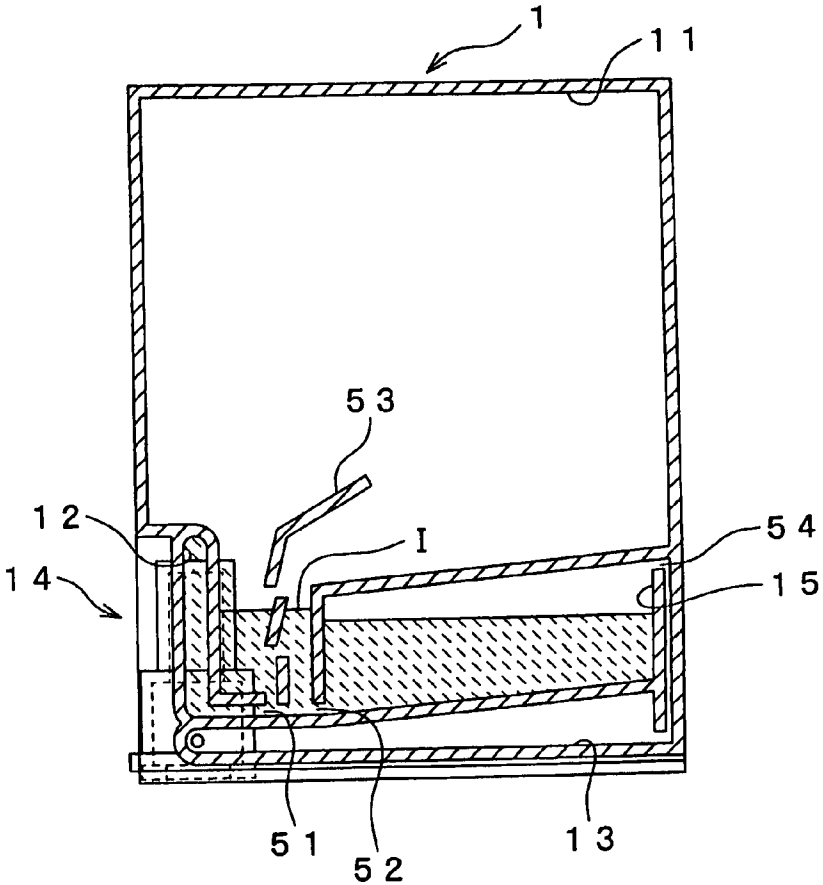
FIGS. 3A and 3B are cross sectional views of the ink cartridge of FIG. 1 for explaining a function of a buffer tank.
Figure 3A:
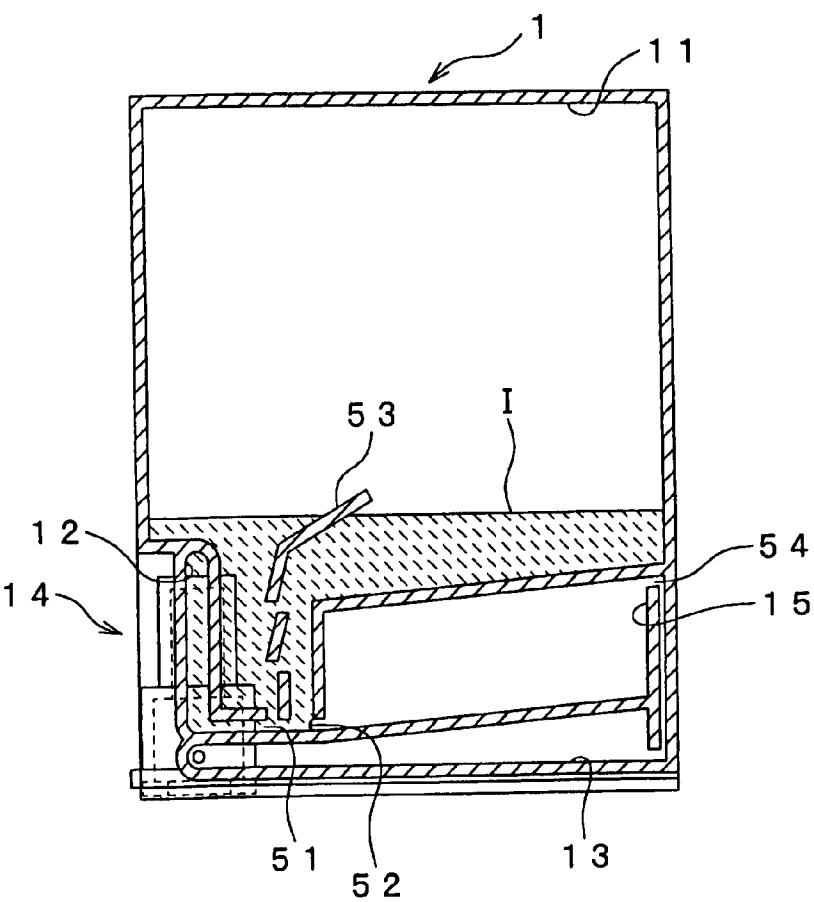

By referring next to FIGS. 3A and 3B, there will be explained a function or operation of the buffer tank 15 when the volume of the air introduced into the ink tank 11 expands due to a change in the temperature, and so on. FIG. 3A shows the ink cartridge 1 in cross section before the expansion of the volume of the air and FIG. 3B shows the ink cartridge 1 in cross section after the expansion of the volume of the air. FIGS. 3A and 3B show the states of the ink cartridge 1 to which the ink supply conduit 41 (not shown in FIGS. 3A and 3B) is connected.

As shown in FIG. 3A, before the volume of the air in the ink tank 11 expands, the pressure of the air in the buffer tank 15 which is the atmospheric pressure and the pressure of the ink are balanced at the air inlet hole 52, so that the meniscus of the ink is formed at the air inlet hole 52. In this state, when the volume of the air in the ink tank 11 expands due to an increase in the temperature, for instance, the pressure in the ink tank 11 increases. As a result of the increase in the pressure in the ink tank 11, the meniscus at the air inlet hole 52 is broken, so that the ink in the ink tank 11 is forced to flow into the buffer tank 15 via the air inlet hole 52, shown in FIG. 3B. In this instance, the atmosphere-contact level Lc of the ink in the ink cartridge 1 is equal to the level or height of the surface of the ink in the buffer tank 15. The level of the surface of the ink in the buffer tank 15 varies depending upon the degree of expansion of the volume of the air. In the present embodiment, however, the possible level of the surface of the ink in the buffer tank 15 falls within a height range whose lower limit is higher than the height position of the air inlet hole 52 and whose upper limit is lower than the height position of the air intake 54. The height positions of the air inlet hole 52 and the air intake 54 which are respectively the lower limit and the upper limit of the above-indicated height range are determined such that the above-indicated height range falls within a range from −10 mm to −80 mm with respect to the nozzles of the ink-jet printing head 5. Accordingly, even when the volume of the air in the ink tank 11 expands, good ink ejection is assured just as when the volume of the air in the ink tank 11 does not expand.

There will be next explained how to determine a capacity of the buffer tank 15. The capacity of the buffer tank 15 is desirably determined such that the ink does not overflow the buffer tank 15 when the ink in the ink tank 11 flows into the same 15 upon expansion of the volume of the air in the ink tank 11 while minimizing the capacity of the buffer tank 15 to maximize the capacity of the ink tank 11 in the ink cartridge 1. Suppose the entirety of the ink in the ink tank 11 flows into the buffer tank 15 upon expansion of the volume of the air in the ink tank 11 as a case where the maximum amount of the ink flows into the buffer tank 15. In this instance, the capacity of the buffer tank 15 is calculated from the following equations (1) and (2):

$$y=x(1-(T+T\min)/(T+T\max)) \quad (1)$$

$$y=100-x \quad (2)$$

wherein, x: ratio (%) of the capacity of the ink tank 11 with respect to the capacity of the ink cartridge 1, y: ratio (%) of the capacity of the buffer tank 15 with respect to the capacity of the ink cartridge 1, T: absolute temperature (273K), Tmax: maximum temperature, and Tmin: minimum temperature.

On the assumption that a maximum range within which the temperature may change is from 0° C. to 40° C., x is equal to 88.7 and y is equal to 11.3 where Tmax is 40° C. and Tmin is 0° C. Accordingly, the ratio of the capacity of the buffer tank 15 with respect to the capacity of the ink cartridge 1 is determined to be 11.3%. Namely, a ratio (y/x) of the capacity of the buffer tank 15 with respect to the ink tank 11 is determined to be 12.8%. Therefore, where the capacity of the ink tank 11 of the present embodiment is 100 ml, the capacity of the buffer tank 15 is determined to be 12.8 ml or larger to adequately deal with the expansion of the air in the ink tank 11 due to the temperature change ranging from 0° C. to 40° C.

In the illustrated embodiment, even when the level or height of the surface of the ink in the ink tank 11 varies as the ink is consumed, the back pressure acting on the nozzles of the ink-jet printing head 5 does not substantially vary until the level of the ink surface in the ink tank 11 decreases down to the air inlet hole 52. Accordingly, the variation in the back pressure can be suppressed with a simple structure that the air inlet hole 52 is formed in the vicinity of the bottom wall portion which partially constitutes the wall of the ink cartridge 1 defining the ink tank 11. This arrangement wherein the variation in the back pressure can be suppressed is effective to enlarge a range of location of the ink cartridge 1 within which favorable ink ejecting conditions are fulfilled.

In the illustrated embodiment, the height position of the air inlet hole 52 of the ink cartridge 1 is determined to be lower than the height position of the nozzles of the ink-jet printing head 5 by a distance ranging from 10 mm to 80 mm. According to this arrangement, the variation in the back pressure of the ink acting on the nozzles can be suppressed with a simple structure, with the back pressure kept within the range that assures good ink ejecting characteristics of the nozzles of the ink-jet printing head 5.

The dimension of the air inlet hole 52 is determined such that the meniscus is formed owing to the surface tension of the ink, whereby the ink is prevented from leaking from the ink tank 11 when the air flows into the air inlet hole 52.

In the illustrated embodiment, the air inlet hole 52 is located below a mid point between the top and the bottom of the ink tank 11, more specifically, in the vicinity of the bottom of the ink tank 11 when the ink cartridge 1 is mounted on the ink-jet printer 101. This arrangement suppresses the variation in the back pressure of the ink acting on the nozzles without adversely influencing the efficiency with which the ink is consumed.

Even when the volume of the air in the ink tank 11 expands due to the change in the temperature or atmospheric pressure, the ink which has been forced to flow out of the ink tank 11 by the expanded air in the same 11 flows into the buffer tank 15 provided as a part of the air inlet passage 13, thereby preventing leakage of the ink from the nozzles of the ink-jet printing head 5.

Since the height position of the buffer tank is higher than that of the air inlet hole 52 when the ink cartridge 1 is mounted on the ink-jet printer, the entirety of the ink which has flowed into the buffer tank 15 by the expansion of the air in the ink tank 11 returns back to the ink tank 11 owing to its weight when the air contracts, assuring an efficient use of the ink. Further, according to this arrangement, the atmosphere-contact level Lc that is the level of the surface of the ink in the buffer tank 15 which has flowed thereinto due to the expansion of the volume of the air in the ink tank 11 is always kept higher than the air inlet hole 52, whereby the ink flowed into the buffer tank 15 can be smoothly ejected, permitting an efficient use of the ink.

Since the buffer tank 15 is located below the ink tank 11, the ink tank 11 has a sufficiently large volume.

In the illustrated embodiment, the buffer tank 15 includes the air intake 54 through which the air flows into the same 15 and which is located at the highest position in the buffer tank 15 when the ink cartridge 1 is mounted on the ink-jet printer 101. According to this arrangement, most of the space in the buffer tank 15 can be effectively used as a buffer for retaining the ink flowing thereinto.

In the illustrated embodiment, the ink tank 11 includes the guide wall 53 which guides air bubbles introduced through the air inlet hole 52 into the ink tank 11, in the upward direction toward the top of the ink tank 11 along the predetermined route when the ink cartridge 1 is mounted on the ink-jet printer 101. This arrangement is effective to prevent the air bubbles introduced through the air inlet hole 52 from being sucked into the ink outlet hole 51.

Since the guide wall 53 is provided between the ink outlet hole 51 and the air inlet hole 52, the air bubbles which have flowed into the ink tank 11 through the air inlet hole 52 can be further effectively prevented from being sucked into the ink outlet hole 51.

In the illustrated embodiment, the guide wall 53 is discontinuously provided, the flow of the ink existing in the space of the ink tank 11 located on one of opposite sides of the guide wall 53 nearer to the air inlet hole 52 into the ink outlet hole 51 can be assured while preventing the air bubbles from being sucked from the air inlet hole 52 into the ink outlet hole 51.

In addition, since the guide wall 53 is inclined such that an inclination with respect to the vertical direction of the ink cartridge 1 increases with an increase in a distance in the upward direction toward the top of the ink tank 11, the air bubbles which have flowed through the air inlet hole 52 can be further effectively prevented from being sucked into the ink outlet hole 51.

In the illustrated embodiment, the ink cartridge 1 comprises the ink outlet passage 12 which communicates with the ink outlet hole 51 and through which the ink that has flowed out of the ink tank 11 via the ink outlet hole 51 flows to the exterior of the ink cartridge 1. This arrangement assures a reliable ink flow from the ink cartridge 1 without any undesirable leakage of the ink.

While the preferred embodiment of the present invention has been described above, for illustrative purpose only, it is to be understood that the invention is not limited to the details of the illustrated embodiment, but may be embodied with various changes, modifications and improvements, which may occur to those skilled in the art, without departing from the spirit and scope of the invention.

While the air inlet hole 52 is located in the vicinity of the bottom of the ink tank 11 in the illustrated embodiment, the location of the air inlet hole 52 is not limited to that in the illustrated embodiment. For instance, the air inlet hole 52 may be located at a position higher than the bottom of the ink tank 11, provided that it is located within an area of the wall of the ink cartridge 1 defining the ink tank 11, in which the air inlet hole 52 contacts the ink stored in the ink tank 11.

Where the air inlet hole 52 is arranged to be located as described above, the atmosphere-contact level Lc of the ink in the ink tank 11 does not change during a time period starting from a time point at which the ink tank 11 is full of the ink till a time point at which the level of the ink surface in the ink tank 11 decreases below the air inlet hole 52. Therefore, the variation in the back pressure of the ink acting on the nozzles of the ink-jet printing head 5 is inhibited during this time period. Where the air inlet hole 52 is provided at a position other than the vicinity of the bottom of the ink tank 11, it is preferable that the height position of the air inlet hole 52 is lower than the height position of the nozzles by a distance ranging from 10 mm to 80 mm, while preventing the leakage of the ink from the nozzles and permitting the ink to be ejected from the nozzles at a predetermined ejection pressure without suffering from a decrease in the amount of the ejected ink. Where the air inlet hole 52 is provided at a position other than the vicinity of the bottom of the ink tank 11, the ink is consumed until the surface level of the ink in the ink tank 11 decreases below the air inlet hole 52, and subsequently the atmosphere-contact level Lc of the ink in the ink cartridge 1 gradually decreases with a decrease in the surface level of the ink. In this instance, even if there remains the ink in the ink tank 11, it is preferable to stop the use of the ink cartridge 1 when Ln-Lc is lowered than −80 mm. Therefore, the air inlet hole 52 needs to be located below the mid point between the top and the bottom of the ink tank 11 in order to allow the ink to be used up to a certain extent.

Where the buffer tank 15 is arranged to have a bottom surface area as large as possible, the variation in the surface level of the ink flowing into the buffer tank 15 is small, resulting in a reduction in the variation in the back pressure of the ink when the back pressure acting on the nozzles varies due to the variation in the surface level of the ink in the buffer tank 15.

In the illustrated embodiment, the ratio of the capacity of the buffer tank 15 capable of dealing with the expansion of the air in the ink tank 11 due to the change in the temperature within the range from 0° C. to 40° C. is obtained on the assumption that the maximum range in which the temperature may change is from 0° C. to 40° C. The ratio of the capacity of the buffer tank 15 is preferably determined depending upon the change in the temperature of the environment in which the ink cartridge 1 is used. For instance, in the environment wherein the maximum range in which the temperature may change is relatively narrow (e.g., from 10° C. to 25° C.), the ratio y of the capacity of the buffer tank 15 with respect to the capacity of the ink cartridge 1 is equal to 4.79 and the ratio y/x of the capacity of the buffer tank 15 with respect to the capacity of the ink tank 11 is equal to 5.03%. Accordingly, the capacity of the buffer tank 15 may be determined to be 5.03 ml or larger where the capacity of the ink tank 11 is 100 ml. In this case, the capacity of the ink tank 11 can be made larger than that in the illustrated embodiment, effectively increasing the amount of ink to be used for recording.

When the maximum range of change in the temperature is determined to be relatively large, i.e., from −10° C. to 50° C., for permitting the ink cartridge 1 to withstand various possible environments in which the ink cartridge 1 is to be used, the above-indicated ratio y is equal to 15.67 and the ratio y/x is equal to 18.58%. Accordingly the capacity of the buffer tank 15 needs to be as large as 18.58 ml or larger where the capacity of the ink tank 11 is 100 ml. In view of the above, the ratio y/x of the capacity of the buffer tank 15 with respect of the capacity of the ink tank 11 is preferably held in a range from not less than 5% to not greater than 20%. This arrangement prevents an overflow of the ink in the buffer tank 15 while assuring a sufficient capacity of the ink tank 11.

In the illustrated embodiment, the air inlet passage 13 includes as a part thereof the buffer tank 15. The ink cartridge 1 may be arranged not to have the buffer tank 15.

In the illustrated embodiment, the height position of the buffer tank 15 is higher than that of the air inlet hole 52. The height position of the buffer tank 15 may be the same as, or lower than, the height position of the air inlet hole 52.

While, in the illustrated embodiment, the buffer tank 15 is located below the ink tank 11, the buffer tank 15 may be located at a height position which is the same as, or higher than, the ink tank 11.

In the illustrated embodiment, the air intake 54 is provided in the vicinity of the top of the buffer tank 15. The air intake 54 may be provided at a portion of the buffer tank 15 other than the vicinity of the top thereof.

In the illustrated embodiment, the ink tank 11 includes the guide wall 53 provided between the ink outlet hole 51 and the air inlet hole 52. The guide wall 53 may be provided otherwise. For instance, the guide wall 53 may be provided above the ink outlet hole 51 and the air inlet hole 52. The ink tank 11 may be arranged without the guide wall 53. Further, the shape of the guide wall 53 is not limited to that in the illustrated embodiment, but may have any other shapes, such as a cylindrical shape.

While the guide wall 53 in the illustrated embodiment is discontinuously provided, the guide wall 53 may be continuously provided.

In the illustrated embodiment, the guide wall 53 is inclined such that an inclination with respect to the vertical direction of the ink cartridge 1 increases with an increase in a distance in the upward direction toward the top of the ink tank 11. The guide wall 53 may be otherwise constructed. For instance, the guide wall may extend in the vertical direction of the ink cartridge 1 without being inclined.

In the illustrated embodiment, the wall of the buffer tank 15 which constitutes the bottom of the buffer tank 15 (the bottom wall of the buffer tank 15) is constructed to be inclined such that the height of the bottom wall gradually decreases in a direction toward the air inlet hole 52. The buffer tank 15 may be otherwise constructed. For instance, the bottom wall may be constructed such that it is disposed to be horizontal. Where the bottom wall is constructed such that the height gradually decreases in the direction toward the air inlet hole 52, the ink which has entered the buffer tank 15 is readily introduced into the ink outlet passage 12 via the air inlet hole 52, so that the ink can be effectively used.

What is claimed is:

1. An ink cartridge which is to be mounted on an ink-jet printer and from which ink is supplied to at least one nozzle of an ink-jet printing head of the ink-jet printer, the ink cartridge comprising:

an ink tank in which ink is stored; an ink outlet hole which is formed in a wall of the ink cartridge that defines the ink tank and through which the ink flows out of the ink tank; and an air inlet hole which is formed in the wall of the ink cartridge that defines the ink tank and through which air flows into the ink tank, the air inlet hole being formed within an area of the wall in which the air contacts the ink stored in the ink tank at the air inlet hole.

2. The ink cartridge according to claim 1, wherein the ink outlet hole is located at a height position which is the same as or lower than a height position of the air inlet hole when the ink cartridge is mounted on the ink-jet printer.

3. The ink cartridge according to claim 1, wherein a height position of the air inlet hole is lower than a height position of the at least one nozzle by a distance ranging from not less than 10 mm to not greater than 80 mm when the ink cartridge is mounted on the ink-jet printer.

4. The ink cartridge according to claim 3, wherein a height position of the ink outlet hole is lower than the height position of the at least one nozzle by a distance ranging from not less than 10 mm to not greater than 80 mm and is the same as or lower than the height position of the air inlet hole.

5. The ink cartridge according to claim 3, wherein a difference between the height position of the air inlet hole and a height position of the ink outlet hole is not greater than 70 mm.

6. The ink cartridge according to claim 1, wherein the air inlet hole is located below a mid point between a top and a bottom of the ink tank when the ink cartridge is mounted on the ink-jet printer.

7. The ink cartridge according to claim 1, wherein the air inlet hole is located in the vicinity of a bottom of the ink tank when the ink cartridge is mounted on the ink-jet printer.

8. The ink cartridge according to claim 1, further comprising an air inlet passage which communicates with the air inlet hole and through which the air flows from an exterior of the ink cartridge to the air inlet hole, at least a part of the air inlet passage constituting a buffer portion for storing the ink flowing out of the ink tank upon expansion of the air in the ink tank.

9. The ink cartridge according to claim 8, wherein the buffer portion is located at a height position which is higher than a height position of the air inlet hole when the ink cartridge is mounted on the ink-jet printer.

10. The ink cartridge according to claim 9, wherein the buffer portion is located below the ink tank.

11. The ink cartridge according to claim 8, wherein the buffer portion includes an air intake through which the air flows into the buffer portion and which is located at a highest position in the buffer portion when the ink cartridge is mounted on the ink-jet printer.

12. The ink cartridge according to claim 8, wherein the buffer potion has a capacity ranging from not less than 5% to not greater than 20% of a capacity of the ink tank.

13. The ink cartridge according to claim 1, wherein the ink tank includes a guide wall which guides air bubbles introduced through the air inlet hole into the ink tank, in an upward direction toward a top of the ink tank along a predetermined route when the ink cartridge is mounted on the ink-jet printer.

14. The ink cartridge according to claim 13, wherein the air inlet hole and the ink outlet hole are spaced apart from each other in a direction intersecting a vertical direction of the ink cartridge and the guide wall is provided between the ink outlet hole and the air inlet hole.

15. The ink cartridge according to claim 13, wherein the guide wall is discontinuously provided.

16. The ink cartridge according to claim 13, wherein the guide wall is inclined such that an inclination with respect to a vertical direction of the ink cartridge increases with an increase in a distance in the upward direction toward the top of the ink tank.

17. The ink cartridge according to claim 13, wherein the guide wall is provided so as to guide the air bubbles such that the air bubbles move away from the ink outlet hole.

18. The ink cartridge according to claim 1, further comprising an ink outlet passage which communicates with the ink outlet hole and through which the ink which has flowed out of the ink tank via the ink outlet hole flows to an exterior of the ink cartridge.

19. An ink-jet printer, comprising:

an ink-jet printing head having an ink ejection portion in which a plurality of ink ejection nozzles are arranged; and an ink cartridge which is to be removably mounted on the ink-jet printer for supplying ink to the ink-jet printing head and which includes an ink tank in which the ink is stored, an ink outlet hole which is formed in a wall of the ink cartridge that defines the ink tank and through which the ink flows out of the ink tank, an air inlet hole which is formed in the wall of the ink cartridge that defines the ink tank and through which air flows into the ink tank, the air inlet hole being formed within an area of the wall in which the air inlet hole contacts the ink stored in the ink tank and located at a height position which is lower than a height position of the nozzles by a distance ranging from not less than 10 mm to not greater than 80 mm when the ink cartridge is mounted on the ink-jet printer.

* * * * *